US005902531A

United States Patent [19]

Berger et al.

[11] Patent Number: 5,902,531

[45] Date of Patent: May 11, 1999

[54] APPARATUS AND METHOD FOR SPINNING POLYMERIC YARNS

[75] Inventors: Peter Berger, Cornelius, N.C.; Egon Gathmann, Remscheid, Germany; Wolfgang Imping, Remscheid, Germany; Klaus Schäfer, Remscheid, Germany; Rahim Gross, Hechingen, Germany; Georg Stausberg, Remscheid, Germany

[73] Assignee: Barmag AG, Remscheid, Germany

[21] Appl. No.: 08/954,812

[22] Filed: Oct. 21, 1997

[30] Foreign Application Priority Data

Oct. 21, 1996 [DE] Germany ..... 196 43 351

[51] Int. Cl.[6] ..... D01D 1/06; D01D 5/08

[52] U.S. Cl. ..... 264/103; 264/210.8; 264/211; 264/211.12; 425/145; 425/204; 425/206; 425/378.2; 425/382.2; 425/464

[58] Field of Search ..... 264/103, 210.8, 264/211, 211.12; 425/145, 204, 206, 378.2, 382.2, 464

[56] References Cited

U.S. PATENT DOCUMENTS

| | | | |
|---|---|---|---|
| 3,881,850 | 5/1975 | Stockbridge | 425/382.2 X |
| 4,617,235 | 10/1986 | Shinonome et al. . | |
| 5,516,476 | 5/1996 | Haggard et al. | 264/211 |
| 5,637,331 | 6/1997 | Lenk et al. | 425/206 |

FOREIGN PATENT DOCUMENTS

| | | |
|---|---|---|
| 24 30 533 | 1/1975 | Germany . |
| WO 94/19516 | 9/1994 | WIPO . |
| WO 96/14450 | 5/1996 | WIPO . |

OTHER PUBLICATIONS

Report on 33rd International Manmade Fibre Symposium, Dornbirn, 1994, pp. 1–11 and attachments.

Patent Abstracts of Japan, vol. 018, No. 377 (C–1225), Jul. 15, 1994 & JP 06 101110 A (Mitsubishi Rayon Co. Ltd.), Apr. 12, 1994.

Patent Abstracts of Japan, vol. 006, No. 011 (C–088), Jan. 22, 1982 & JP 56 134208 A (Unitika Ltd.) Oct. 20, 1981.

Patent Abstracts of Japan, vol. 010, No. 383 (C–393), Dec. 23, 1986 & JP 61 174412 A (Nippon Ester Co. Ltd.), Aug. 6, 1986.

Patent Abstracts of Japan, vol. 010, No. 208 (C–361), Jul. 22, 1986 & JP 61 047808 A (Nippon Ester Co. Ltd.), Mar. 8, 1986.

Patent Abstracts of Japan, vol. 007, No. 235 (C–191), Oct. 19, 1983 & JP 58 126311 A (Nippon Ester KK), Jul. 27, 1983.

Patent Abstracts of Japan, vol. 009, No. 271 (C–311), Oct. 29, 1985 & JP 60 119211 A (Teijin KK), Jun. 26, 1985.

*Primary Examiner*—Leo B. Tentoni
*Attorney, Agent, or Firm*—Alston & Bird LLP

[57] ABSTRACT

An apparatus and method for melt spinning polymeric yarns, wherein a main melt flow is generated by an extruder and supplied to a spin head. The spin head is enclosed in a heated spinning beam and comprises a mixer, a distributor pump and a plurality of spinnerets. A feed device generates a secondary flow which is supplied to the main melt flow for the purpose of additive admixture. The secondary flow and the main melt flow are combined inside the spinning beam.

14 Claims, 7 Drawing Sheets

APPARATUS AND METHOD FOR SPINNING POLYMERIC YARNS

BACKGROUND OF THE INVENTION

The present invention relates to an apparatus and method for spinning polymeric yarn of the type wherein an extruder heats and melts a polymeric material and delivers the resulting melt to a spin head which includes one or more spinnerets. The melt is extruded through each of the spinnerets to form a downwardly advancing bundle of filaments, and the filaments are gathered together to form a yarn which is wound into a package.

A melt spinning apparatus as described above is described, for example, in the detailed conference report on the 33rd International Manmade Fibre Symposium, Dornbirn, 1994, pages 1–11. In this described apparatus, additives, e.g. for ultraviolet stabilization or spin-dyeing, are supplied through an auxiliary extruder to the melt in the main extruder. Feeding of the additives is effected at the end of the main extruder into a dynamic mixer. From there the melt passes through a melt line to a spin head, which comprises an extrusion pump and a spinneret.

In spinning installations, the main extruder simultaneously supplies a plurality of spinnerets of a spin head disposed in a spinning beam. In so doing, the melt is directed from the main extruder to a distributor pump. Such a distributor pump, of the type known from WO 94/19516 and corresponding U.S. Pat. No. 5,637,331, divides the main melt flow into a plurality of individual partial flows and directs each of the latter to a spinneret.

With the known apparatus the problem arises that a change of additives, e.g. a change of color, results in extended non-productive periods for the installation. In order to be able to spin the new grade of yarn, the installation has to be rinsed from the end of the main extruder to the spinning head.

Such spinning installations have the added drawback that the entire spinning installation may simultaneously produce only yarns of a typical melt composition.

It is accordingly an object of the present invention to provide a melt spinning apparatus and method wherein the admixture of the additives may occur as late as possible in the processing sequence of the melt.

A further object of the invention is to design the apparatus and method in such a way that the spinning installation may be operated with the maximum degree of flexibility.

SUMMARY OF THE INVENTION

The above and other objects and advantages of the present invention are achieved by the provision of a melt spinning apparatus which comprises a spinning beam enclosing a spin head which includes a mixer, a distribution pump, and a plurality of spinnerets. An extruder delivers a main melt flow through a melt line which leads to the spin head in the spinning beam, and a feed device delivers a secondary material flow through a supply line which leads to the spin head in the spinning beam. The interior of the spinning beam is preferably heated by a circulating heating medium, so as to heat the components of the spin head.

With the present invention, the secondary flow which typically comprises an additive, and the main melt flow are combined inside the spinning beam. This offers the special advantage of a low residence time and hence low thermal stressing of the additive. As a result, it is also possible to process temperature-sensitive additives. It is moreover possible to achieve short changeover times upon a change of additives.

The combination of the main melt flow and the secondary flow is preferably effected in the mixer of the spin head. This achieves a uniform blending of the main melt flow and secondary flow, and in addition, it has the added advantage that a high degree of flexibility of the spinning installation is achieved. In installations where several spin heads are positioned in the spinning beam, all of the spin heads may be supplied by one main extruder, while each individual spin head may be supplied individually in terms of additive admixture. By so combining the secondary flow and the main melt flow, a high uniformity of distribution is achieved even in the event of large differences in viscosity between the polymer melt and additives. The method also has the advantage that small quantities of the additive may be added precisely and reproducibly to the main melt flow.

It is advantageous to have the secondary flow generated inside the spinning beam. In such case, the thermal energy of the spinning beam is simultaneously utilized for heat treatment of the additive. This method variant is therefore particularly suitable for additives present in a meltable consistency.

The secondary flow may be generated by a secondary extruder which is positioned to be heated by the heating medium of the spinning beam. This embodiment is particularly advantageous when other polymer materials or a masterbatch has to be added to the main melt flow. The melting energy is once more obtained from the spinning beam heating.

For pressure control, it is advantageous when the secondary flow upon leaving the secondary extruder is fed by means of a feed pump. In this case, the secondary extruder may be operated at a low pressure level, resulting in a positive influence upon wear.

It is particularly advantageous when the pump admission pressure of the feed pump is set by means of a radial screw clearance of the secondary extruder. By such means, the degree of admission of the pump may advantageously be kept constant. The screw clearance is defined, here, as the gap between the outside diameter of the screw of the secondary extruder and the inside diameter of the cylinder walls of the secondary extruder. Given such construction, the feed pump always has enough melt available.

The feed pump and the secondary extruder are preferably coaxially disposed so that the extruder screw and the feed pump may be powered by a singe drive motor.

The method variant, in which the additive or granulate is supplied in a metered manner, is advantageous for obtaining a constant capacity utilization of the secondary extruder. In such case, the degree of admission of the pump is determined by the throughput of the secondary extruder.

The apparatus according to the invention is notable for the fact that the feed device for generating the additive secondary flow is connected directly by a supply line to the spinning beam. Thus, very short paths are realized between the feed device and the spin head, with the result that short rinsing periods are achieved.

The main melt flow may be divided into a plurality of individual melt flows, and the secondary flow may be divided into a plurality of partial flows, both of which are supplied to a plurality of spin heads in the spin beam. This arrangement provides for a high degree of flexibility of the spinning installation. Thus, faults in the feed device at a single spin head do not lead to extensive interruptions of the entire installation.

By having the additive supply line pass into the spin head, it is assured that the additives may be uniformly heated as they are delivered to the spin head. Also, the feed advice for the additive may take the form of a secondary extruder which has part of its length disposed inside the spinning beam. Thus heating of the secondary extruder by the spinning beam may be achieved. Such a device is suitable particularly for melting small quantities of an additional polymer material and supplying them to the main melt flow. It also has the advantage that the secondary extruder can operate with a lower pressure, with the result that the extruder parts wear less quickly.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENT

Figure 1:
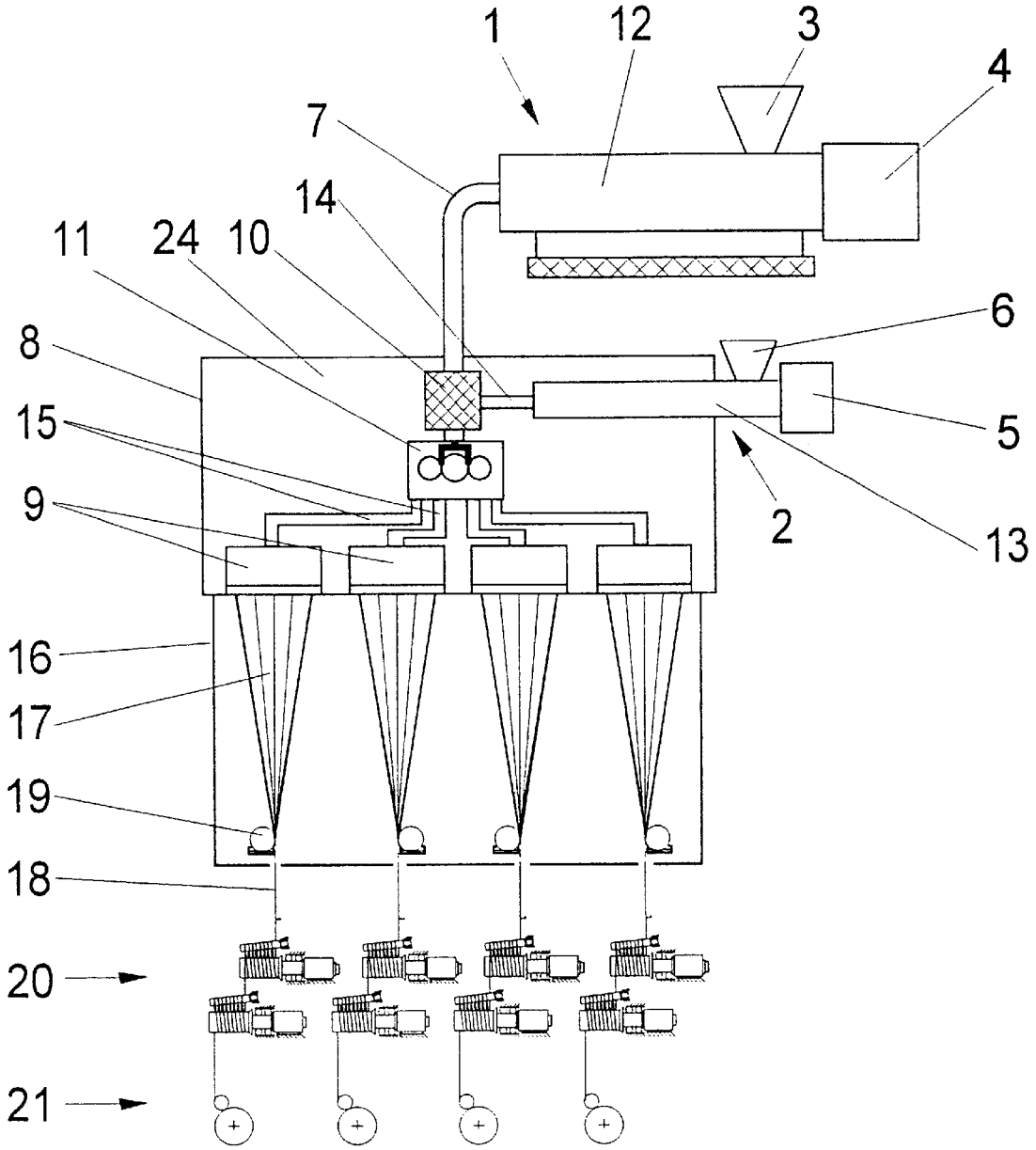
FIG. 1 is a diagrammatic view of a melt spinning installation which embodies the features of the present invention.

FIG. 1 is a diagrammatic view of a melt spinning installation for spinning thermoplastic yarns. The thermoplastic material is introduced through a filling device 3 into the extruder 1, which is driven by a motor 4. The thermoplastic material is melted in the extruder 1. This is effected, on the one hand, by the work of deformation (shear force) introduced into the material by the extruder 1. In addition, a heating device (not shown here) is provided. The melt passes through the melt line 7 to a spin head 24. In the illustrated embodiment, the spin head 24 includes a mixer 10, a distributor pump 11 and a plurality of spinnerets 9, which are disposed in a spinning beam 8 and heated by a heat transfer liquid or vapor. The melt line 7 is connected to the mixer 10. A secondary extruder 2 is arranged with its extruder cylinder 13 partially in the spinning beam 8. The secondary extruder is charged via the filling device 6. Driving of the secondary extruder 2 is effected by the motor 5. Inside the spinning beam 8 the secondary extruder 2 is connected by the supply line 14 to the mixer 10. Thus, the additives introduced through the filling device 6 may pass as a secondary flow generated by the secondary extruder through the supply line to the mixer 10. In the mixer 10 the main melt flow exiting from the melt line 7 and the secondary flow are blended. After blending, the melt is supplied to the distributor pump 11. The arrangement of the secondary extruder 2 is selected in such a way that the energy required for melting of the additives is removed from the heating system of the spinning beam 8. In the distributor pump 11, the main melt flow is divided into a plurality of individual melt flows and directed through the melt distributing lines 15 to the individual spinnerets 9. The spinnerets 9 take the form of round dies having up to 150,000 spinneret holes. The spinnerets 9 spin the polymer melt into filaments. The filament bundles 17 are then conveyed through the blowing shaft 16 and uniformly cooled by means of an air stream. At the end of the blowing shaft 16, the filament bundle is combined into a yarn 18 by means of a preparing device 19. The yarn 18 is then conveyed into the drafting system 20, which comprises two multi-wound godets each having an overflow roller. After drafting, the yarn 18 is then wound into a package at the winding apparatus 21.

Figure 2:
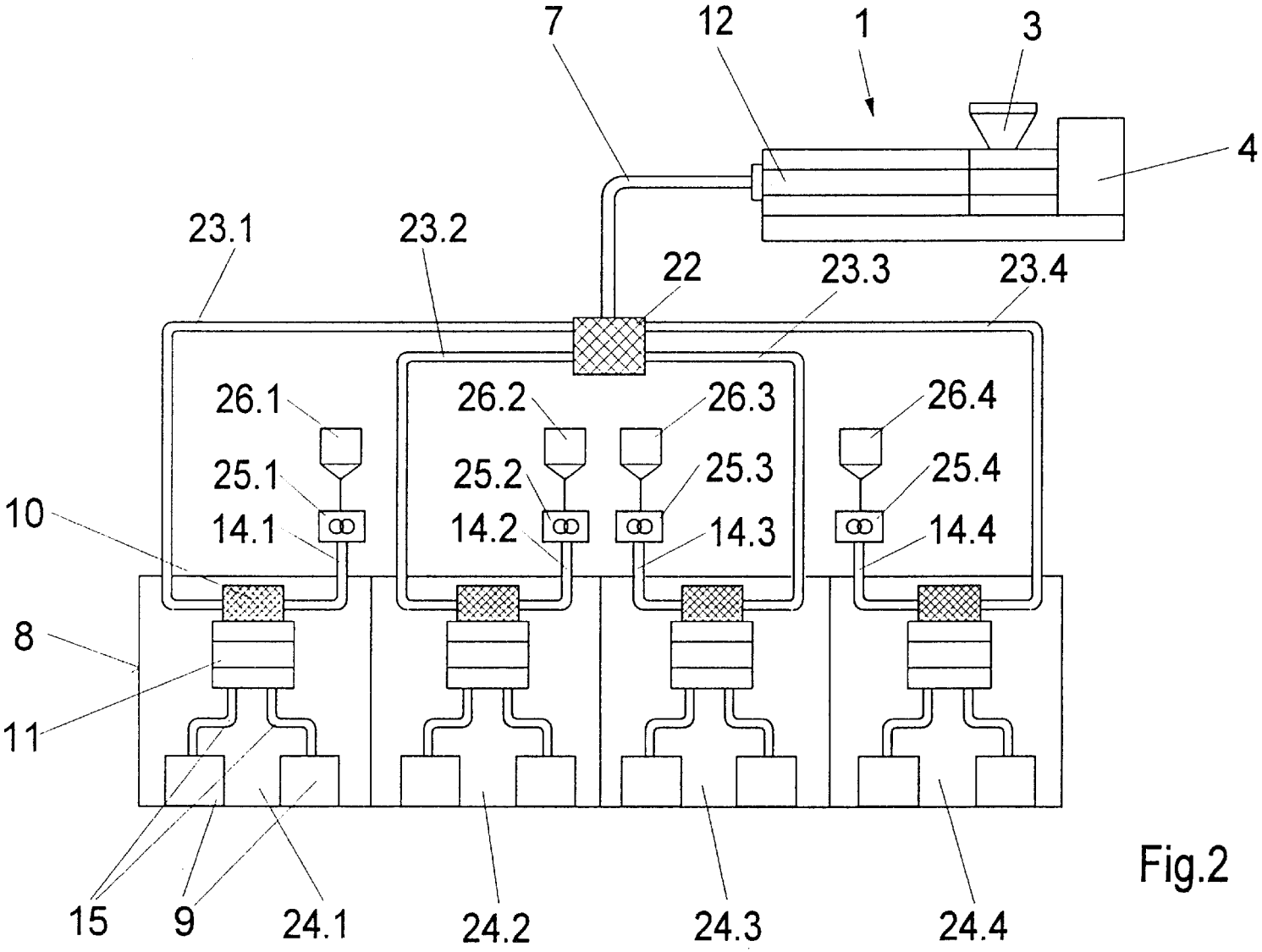
FIGS. 2–3 illustrate further embodiments of the invention.

FIG. 2 shows a further embodiment of a melt spinning installation which embodies the invention. Here, the polymer melt melted by the extruder 1 is fed through the melt line 7 to a filter 22. In the filter 22 the main melt flow is allocated to the individual melt lines 23.1, 23.2, 23.3 and 23.4. Each of the individual melt lines directs the melt flow to a spin head 24.1 to 24.4, which are disposed in a spinning beam 8. The spinning beam 8 is heated by diphenyl-diphenyloxide. Each of the spin heads 24.1 to 24.4 comprises a mixer 10, a distributor pump 11 and a plurality of spinnerets 9. A feed device is associated with each of the spin heads 24.1 to 24.4. The feed device comprises a charging device 26.1–26.4 which is connected to a pump 25.1–25.4. The pump 25.1–25.4 is in turn connected by the supply line 14 to the mixer 10 of the respective spin head. In this arrangement, the feed device is disposed substantially outside of the spin head and the spinning beam. The installation is therefore particularly suitable for temperature-sensitive additives which are capable of withstanding only a short residence time at a higher temperature. In addition, the spinning installation promotes short changeover times as no rinsing of the distributing lines between the main extruder and the spin head is required. The feed device shown in FIG. 2 is advantageously used to add liquid or powdery additives to the main melt flow.

Figure 3:
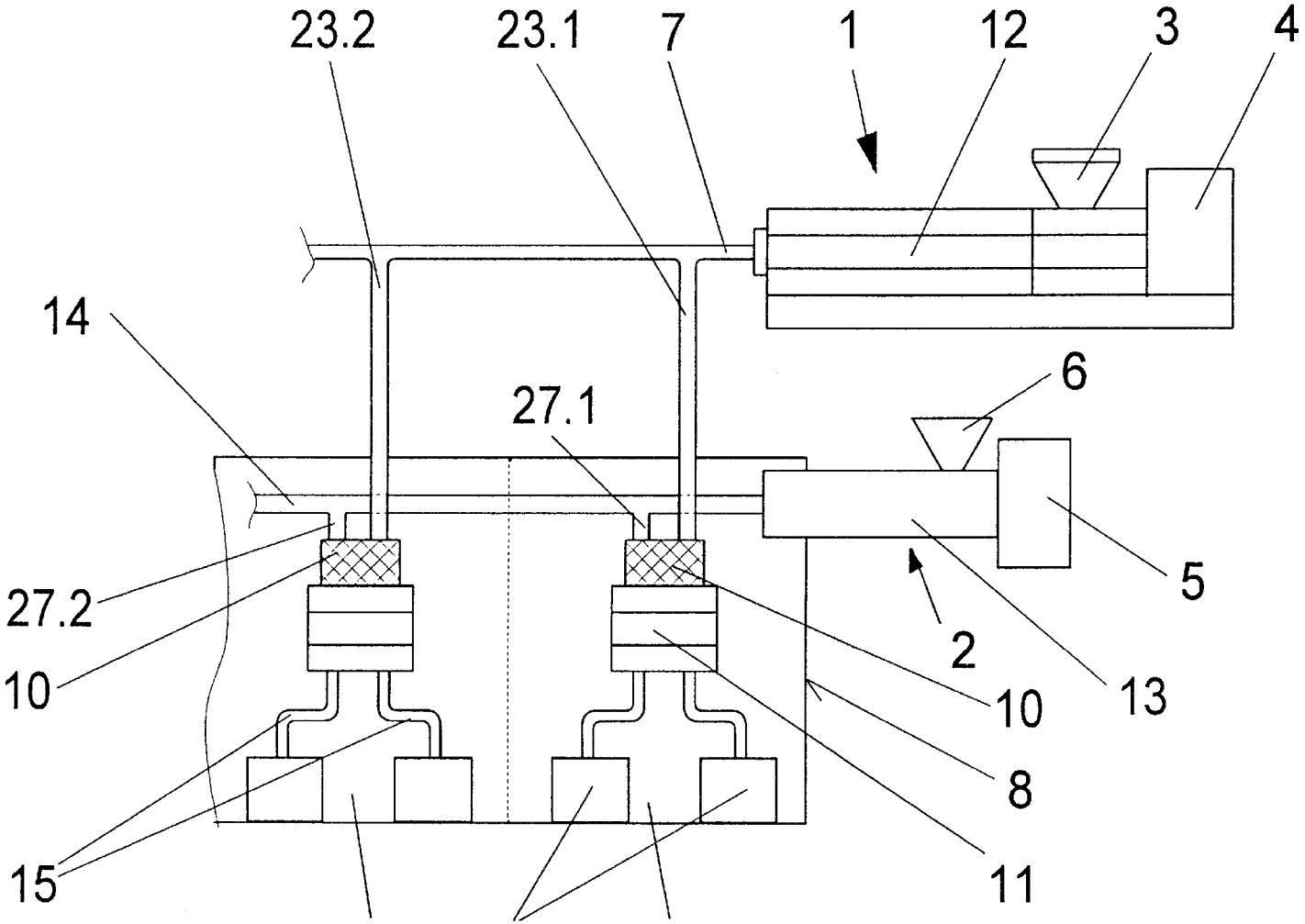

FIG. 3 shows a further embodiment of the invention. Here, in the manner already described in FIG. 2 the main melt flow is divided and supplied through each of the individual melt lines 23.1; 23.2 to a spin head 24.1; 24.2. For introducing the additives, a secondary extruder 2 is provided which introduces the additives into the supply line 14. The parallel lines 27.1 and 27.2 each branch off from the supply line 14 to a spin head 24.1 and 24.2 respectively, so that the secondary flow is divided. With this arrangement it is possible for a plurality of spin heads in a spinning beam to be supplied by a secondary extruder.

Figure 4:
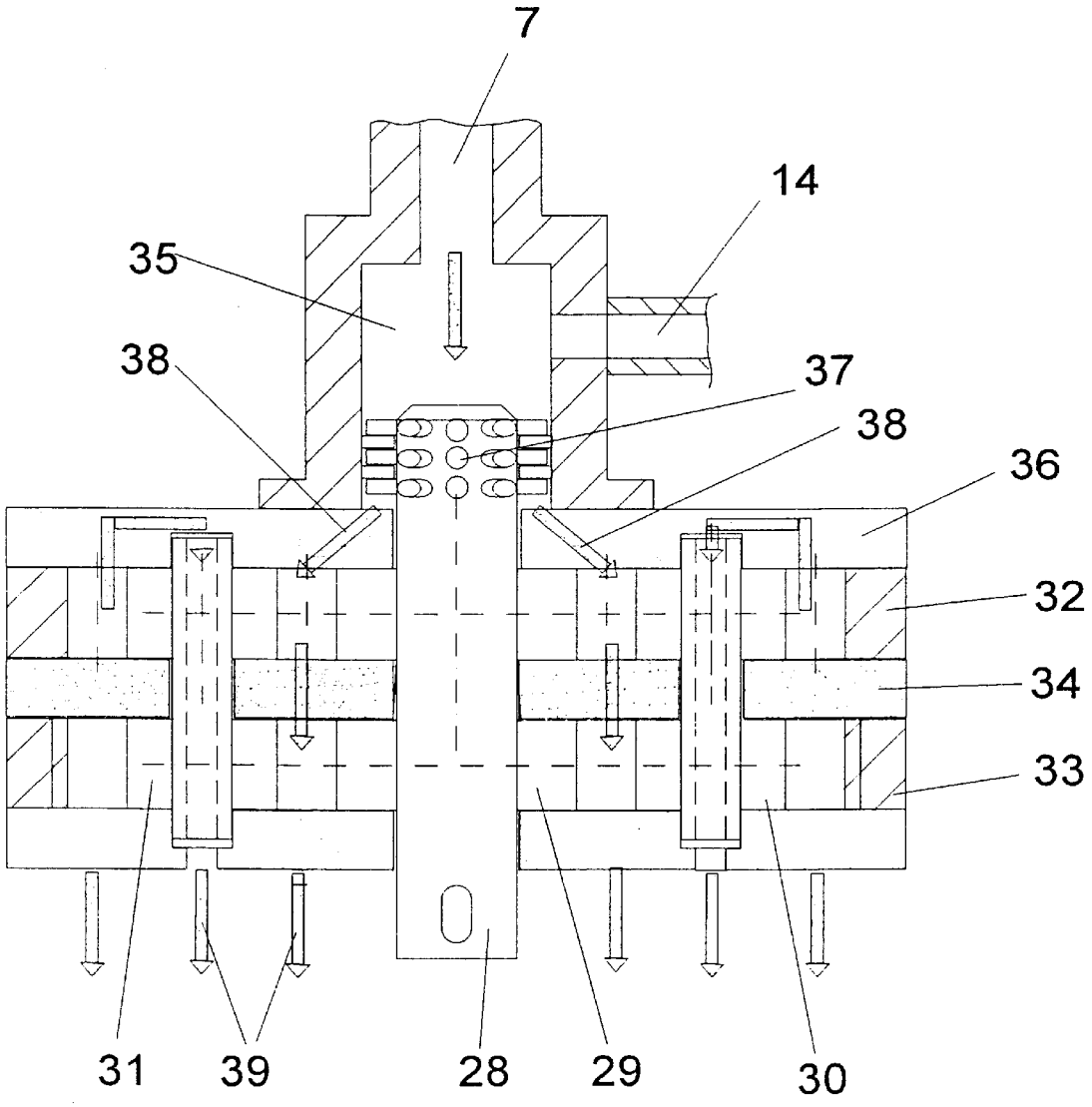
FIG. 4 is a sectional view of an embodiment of a mixer for combining the main melt flow and the secondary flow.

In FIGS. 1 to 3, the combination of the main melt flow and the secondary flow is effected in the mixer 10. In this regard, FIG. 4 indicates an embodiment in which a dynamic mixer is used to blend the two flows. Here, the dynamic mixer is combined with the distributor pump in the manner known from WO 94/19516 and corresponding U.S. Pat. No. 5,637,331, the disclosures of which are expressly incorporated herein by reference. The main melt flow is fed through the melt line 7 into an inlet chamber 35 of the mixer. The secondary flow passes through the supply line 14 likewise into the inlet chamber 35. The inlet chamber 35 lies in alignment with a drive shaft 28 in front of a housing lid 36 of the distributor pump. The pump shaft 28 at its end projecting into the inlet chamber 35 takes the form of a mixing shaft 37. From the mixing chamber 35 the melt passes through the sub-channels 38 to the distributor pump. The distributor pump is formed by two sets of planetary wheels disposed in parallel planes and separated by an intermediate plate 34. The wheel sets are enclosed in a chamber formed by the housing plates 32 and 33. The sun wheel 29 is driven by the drive shaft 28. The sun wheel 29 meshes with the planetary wheels 30 and 31. The melt flow is thereby fed to the outlet channels 39.

Figure 5:
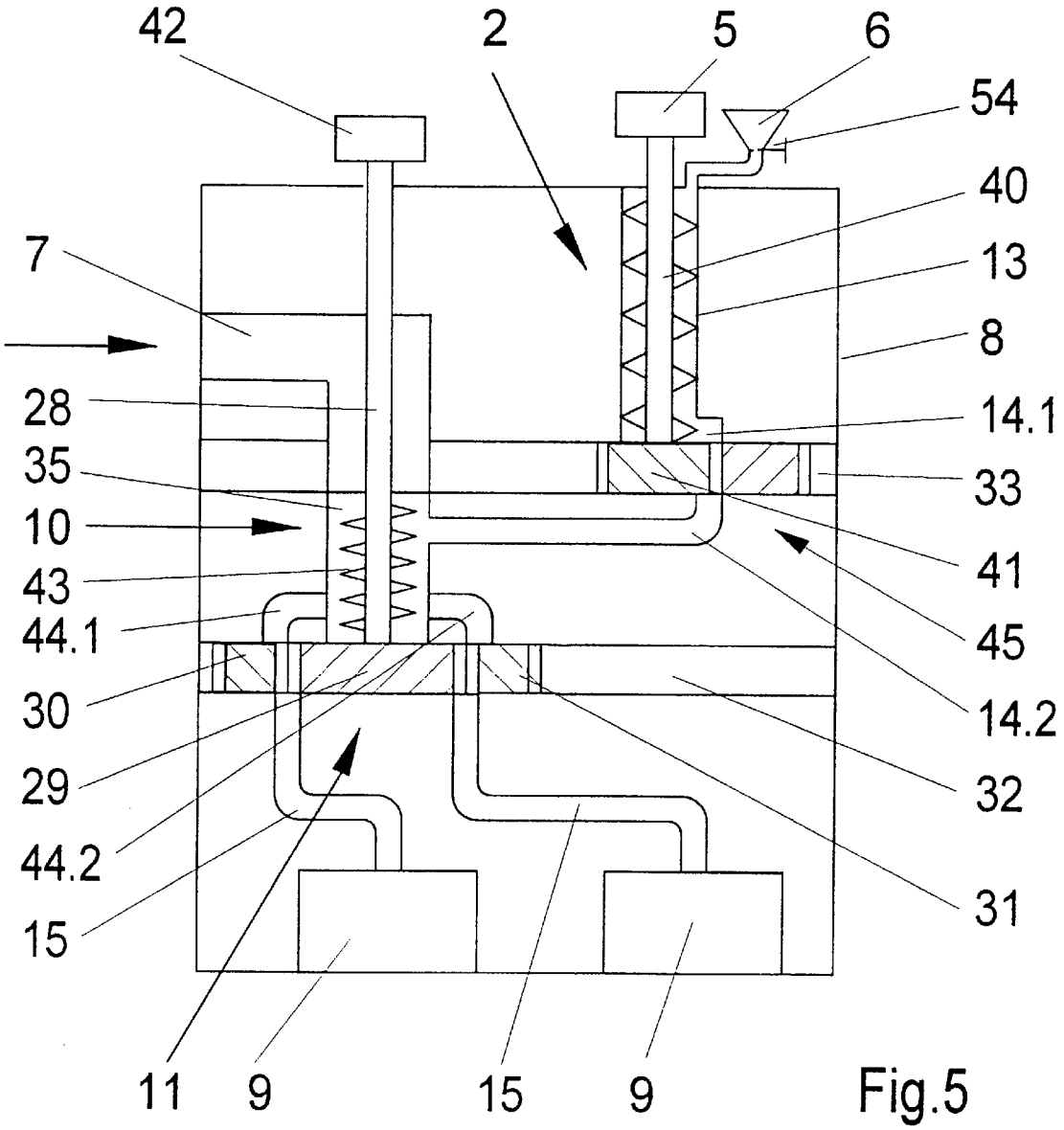
FIG. 5 is a diagrammatic view of a melt spinning installation according to the invention with an integrated secondary extruder.

FIG. 5 shows an embodiment of a spinning beam such as may be used in the spinning installation of FIG. 1 or FIG. 3.

The spinning beam comprises a spin head having the two spinnerets 9, which are connected by the melt distributing lines 15 to the distributor pump 11. The distributor pump 11 comprises a driven sun wheel 29 as well as the planetary wheels 30 and 31. The inlet chamber 35 of the mixer 10 is formed concentrically with the drive shaft 28 of the pump 11. The mixing devices 43 are disposed on the drive shaft 28 inside the inlet chamber 35. The drive shaft 28 terminates outside of the spinning beam and is coupled to the motor 42. The inlet chamber 35 is connected to the melt line 7. Two melt channels 44.1 and 44.2 are formed between the distributor pump 11 and the mixer 10. The supply line 14.2 additionally opens into the inlet chamber 35. The supply line 14.2 connects the mixer 10 to a feed pump 45. The feed pump is disposed inside the housing plate 33. An extruder screw 40 is arranged in alignment with the pump impeller 41. The extruder screw 40 and the pump impeller 41 are connected to one another. The extruder screw 40 is received in the extruder cylinder 13 of the secondary extruder 2. The extruder cylinder 13 is connected to the filling device 6, which includes a metering device 54. The extruder screw terminates outside of the spinning beam and is coupled to the motor 5. The spinning beam is, for example, heated by diphenyl-diphenyloxide.

In the above arrangement, the main melt flow passes through the supply line 7 into the inlet chamber 35 of the mixer 10. At the same time an additive, which has been added in a metered manner through the filling device 6, is melted and homogenized by the secondary extruder 2. The generated secondary flow then passes through the supply channel 14.1 to the feed pump 45. By virtue of metering of the additive the degree of admission of the feed pump 45 is controlled and held constant. The feed pump then delivers the secondary flow through the supply line 14.2 to the inlet chamber 35 of the mixer 10. In the mixer 10, the main melt flow is blended with the secondary flow. The blended melt flow is then directed through the melt channels 44.1 and 44.2 to the distributor pump. The distributor pump acts as a double single pump, which is connected in each case to one of the two spinnerets 9 by the melt distributing line 15.

To keep the degree of admission of the feed pump 45 constant, it is also possible to design the plasticizing screw of the secondary extruder in such a way that the pump admission pressure is regulated by the screw clearance or by a conical gap in the secondary extruder itself. Thus, the pump automatically always has sufficient melt.

A further possibility of influencing the degree of admission of the feed pump is to use the pump admission pressure as a signal for the metering adjustment in the filling device. In such case, the secondary extruder has a variable degree of admission.

Figure 6:
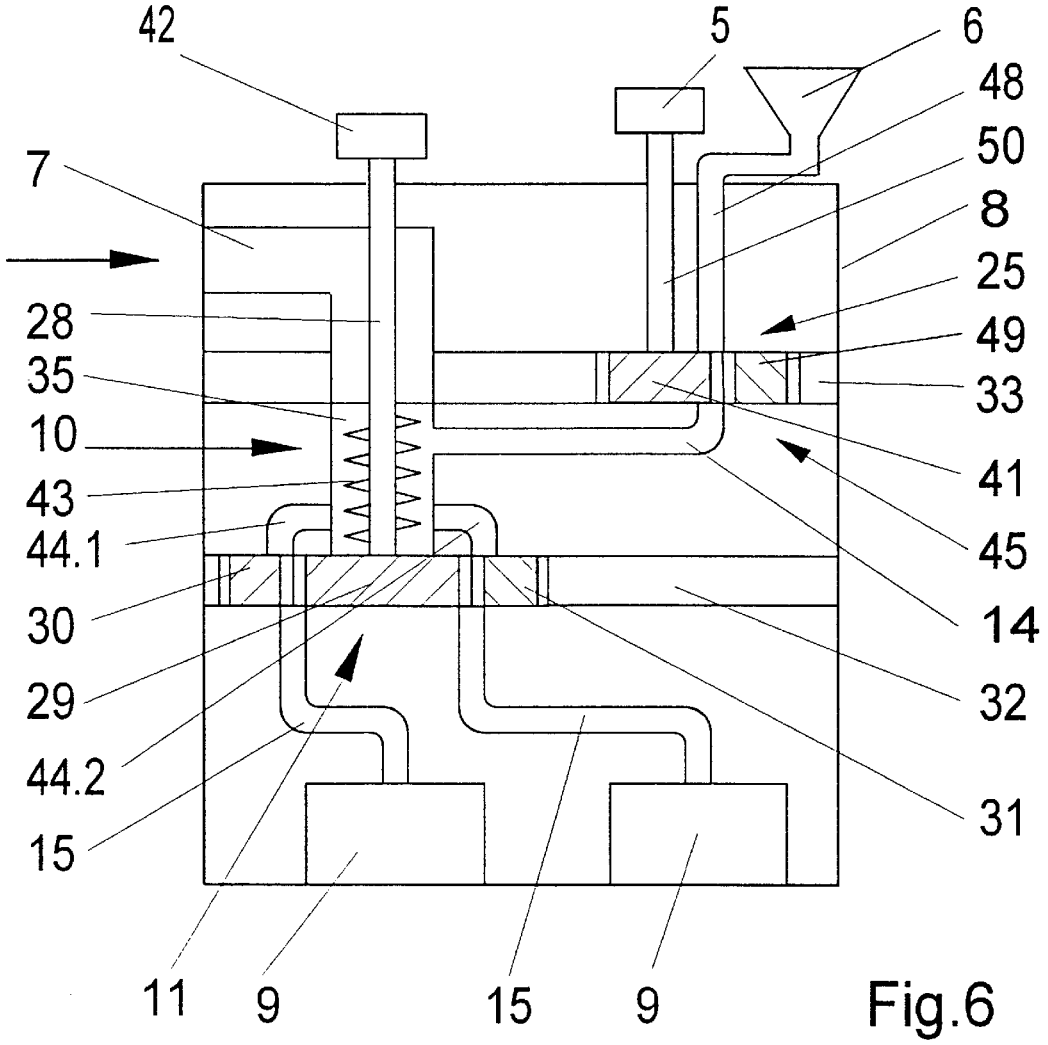
FIGS. 6–7 are diagrammatic views of further embodiments of spinning installation according to the invention.

FIG. 6 shows a spinning beam which is modified compared to the spinning beam of FIG. 5. Here, the feed device is formed by a pump 25 which is connected by the filling device 6 to a feed channel 48. The feed channel 48 and the pump 25 are disposed inside the spinning beam 8. The pump 25 takes the form of a gear pump having the pump impellers 41 and 49. The pump impeller 41 is driven via the drive shaft 50 by the motor 5. The secondary flow thus generated is supplied through the supply line 14 to the mixer 10.

As regards the blending of the main melt flow with the secondary flow as well as the structural arrangement of the spinning head, reference is made to the description relating to FIG. 5.

Figure 7:
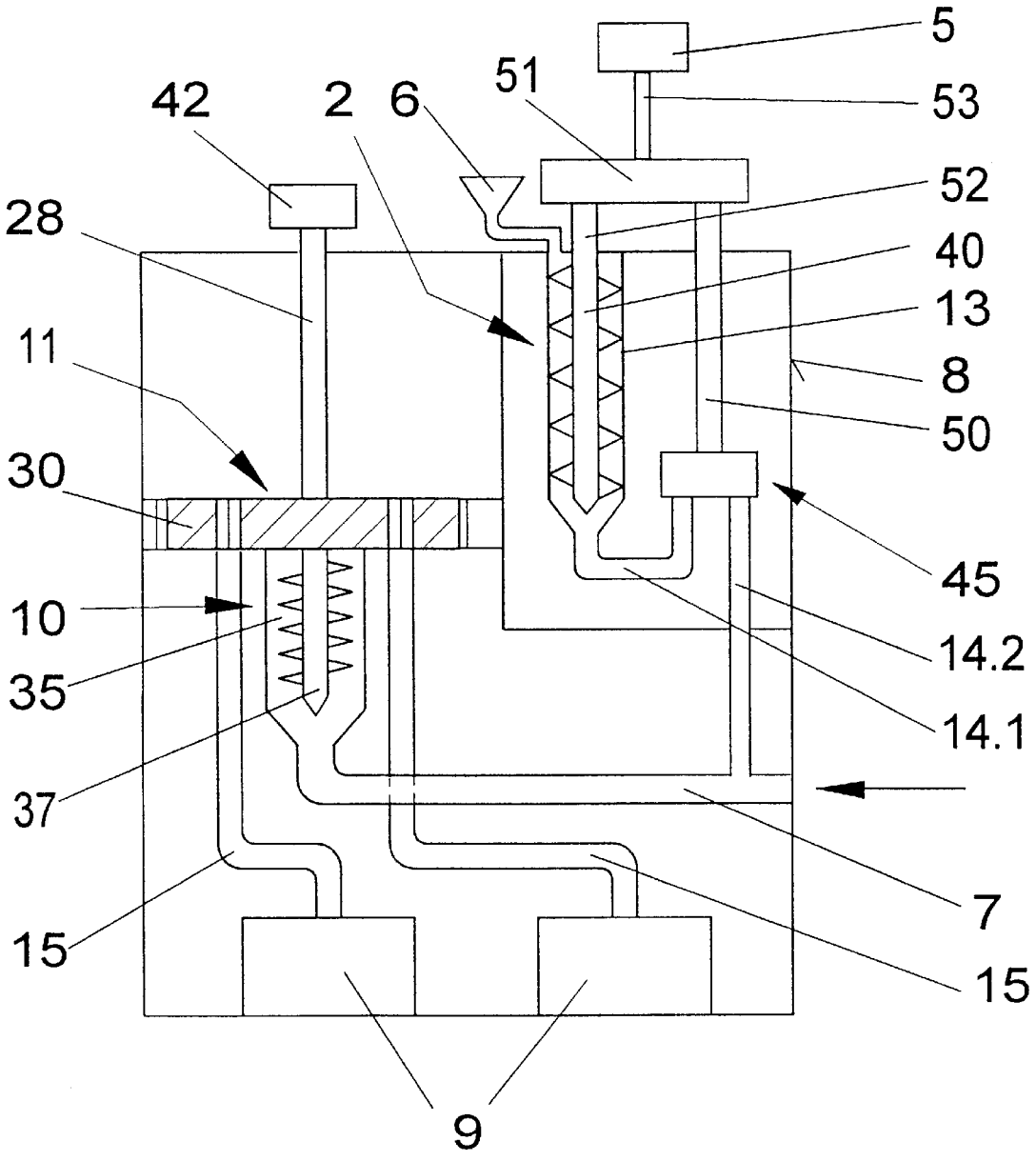

FIG. 7 shows a further embodiment of a spinning beam of the type usable, for example, in the spinning installation of FIG. 1 or FIG. 3. Since the spinning beam of FIG. 7 is a modification of the spinning beam of FIG. 5, reference is made in said respect to the description relating to FIG. 5 and only departures therefrom are described at this point. The mixer 10 is disposed at the side of the distributor pump 11 remote from the drive. The drive shaft 28, which is driven by the motor 42 disposed outside of the spinning beam 8, is lengthened in such a way that the opposite end of the pump drive shaft takes the form of mixing shaft 37 and projects into the mixing chamber 35. The melt line 7 opens into the mixer chamber 35. The supply line 14.2 connects the feed pump 45 to the melt line 7 so that the secondary flow and the main flow enter jointly through one inlet opening into the mixer chamber 35. The feed pump 45 is connected by the supply line 14.1 to the secondary extruder 2. The feed pump and the secondary extruder are arranged in such a way that the drive shaft 50 of the feed pump 45 and the shaft 52 of the extruder screw 40 are driven jointly by a gearing 51. The gearing 51 is connected by a drive shaft 53 to the motor 5.

In principle, the feed device in the embodiment according to FIG. 7 may also be combined with the mixer arrangement from the embodiment according to FIG. 5.

In cases where the feed device is integrated in the spinning beam, the thermal energy needed, for example, to plasticize a color masterbatch is obtained from the heating system of the spinning beam. It is, however, equally possible to use an additional heating system, in particular strip-type heaters, for the secondary extruder.

In the drawings and specification, there has been set forth a preferred embodiment of the invention, and although specific terms are employed, they are used in a generic and descriptive sense only and not for purposes of limitation.

That which is claimed is:

1. An apparatus for melt spinning polymeric yarns comprising a spinning beam enclosing a spin head which includes a mixer, a distribution pump, and a plurality of spinnerets, an extruder for delivering a main melt flow through a melt line which leads to the spin head in the spinning beam, and a feed device for delivering a secondary material flow through a supply line which leads to the spin head in the spinning beam, and such that the main melt flow and the secondary material flow are combined inside the spinning beam.

2. The apparatus as defined in claim 1 wherein the spinning beam includes means for heating the interior thereof.

3. The apparatus as defined in claim 2 wherein the melt line and the supply line combine at or upstream of the mixer of the spin head, and such that the delivered materials are mixed in the mixer.

4. The apparatus as defined in claim 3 wherein said mixer is a dynamic mixer.

5. The apparatus as defined in claim 2 wherein the feed device comprises a secondary extruder, and wherein at least a portion of the length of the secondary extruder is disposed within the spinning beam so as to be heated thereby.

6. The apparatus as defined in claim 5 further comprising a feed pump disposed in the spinning beam and in the supply line between the secondary extruder and the spin head.

7. The apparatus as defined in claim 6 wherein the secondary extruder includes an extruder screw and wherein the feed pump and the extruder screw are rotatably driven by a common drive.

8. The apparatus as defined in claim 7 wherein the feed pump is a gear pump which includes a pump impeller which is coupled to the extruder screw.

9. The apparatus as defined in claim 5 wherein the secondary extruder includes a filling device having a metering device so that the secondary extruder supplies a controlled amount of the secondary material to the supply line.

10. The apparatus as defined in claim 2 wherein said spinning beam encloses a plurality of said spin heads, and wherein said melt line and said supply line are each divided into a plurality of parallel lines leading to respective ones of said spin heads.

11. A method of melt spinning polymeric yarns comprising the steps of providing a spinning beam which encloses a spin head, with the spin head including a mixer, a distribution pump, and a plurality of spinnerets, delivering a main melt flow through a melt line to the spin head in the spinning beam, delivering a secondary material flow through a supply line to the spin head in the spinning beam, and such that the main melt flow and secondary material flow are delivered to the mixer where they are mixed, and the mixed materials are delivered from the mixer to the distribution pump, and then to the plurality of spinnerets, and wherein a bundle of filaments is extruded from each of the spinnerets and formed into an advancing yarn.

12. The method as defined in claim 11 including the further step of heating the interior of the spinning beam so as to heat the spin head.

13. The method as defined in claim 12 wherein the melt line and supply line combine in the spinning beam at or upstream of the mixer of the spin head.

14. The method as defined in claim 12 comprising the further step of drawing each of the advancing yarns, and then winding each of the drawn advancing yarns into a yarn package.

* * * * *